US010059551B2

(12) United States Patent
Kawakami et al.

(10) Patent No.: US 10,059,551 B2
(45) **Date of Patent: *Aug. 28, 2018**

(54) TRANSPORTING DEVICE AND PRINTING APPARATUS

(71) Applicant: SEIKO EPSON CORPORATION, Tokyo (JP)

(72) Inventors: Shinji Kawakami, Shiojiri (JP); Akihiro Toya, Matsumoto (JP); Masaru Jingushi, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 111 days.

This patent is subject to a terminal disclaimer.

(21) Appl. No.: 14/919,543

(22) Filed: Oct. 21, 2015

(65) Prior Publication Data

US 2016/0114997 A1 Apr. 28, 2016

(30) Foreign Application Priority Data

Oct. 23, 2014 (JP) ..... 2014-216239

(51) Int. Cl.
*B65H 20/02* (2006.01)
*B65H 23/188* (2006.01)
(Continued)

(52) U.S. Cl.
CPC ..... *B65H 20/02* (2013.01); *B65H 20/24* (2013.01); *B65H 23/188* (2013.01);
(Continued)

(58) Field of Classification Search
CPC ..... B65H 20/02; B65H 20/10; B65H 20/14; B65H 23/105; B65H 2404/52;
(Continued)

(56) References Cited

U.S. PATENT DOCUMENTS 4,856,205 A * 8/1989 Meyer ..... D21F 5/042 34/117
5,501,412 A * 3/1996 McAleavey ..... B65H 23/245 226/118.5
(Continued)

FOREIGN PATENT DOCUMENTS

JP 59-138550 8/1984
JP 08-156357 6/1996
(Continued)

*Primary Examiner* — Michael C McCullough
(74) *Attorney, Agent, or Firm* — Workman Nydegger

(57) ABSTRACT

A transporting device includes a first driving roller which transports the base material; a second driving roller which is disposed to be closer to a downstream side of the transporting direction than the first driving roller, and transports the base material; a driven roller which nips the base material between the second driving roller and the driven roller, and rotates together with the second driving roller; and an inter-roller transporting path which is provided between the first driving roller and the second driving roller, and through which the base material is transported in a state where the base material is suspended in a direction of gravity and bent. The second driving roller starts winding the base material at a position which is closer to an upstream side of the transporting direction than a position where the driven roller is in contact with the base material.

20 Claims, 8 Drawing Sheets

(51) Int. Cl.
*B65H 20/24* (2006.01)
*B41J 15/00* (2006.01)

(52) U.S. Cl.
CPC ..... *B41J 15/005* (2013.01); *B65H 2301/517* (2013.01); *B65H 2404/133* (2013.01); *B65H 2404/143* (2013.01); *B65H 2408/215* (2013.01); *B65H 2511/112* (2013.01); *B65H 2513/11* (2013.01); *B65H 2701/132* (2013.01); *B65H 2801/15* (2013.01)

(58) Field of Classification Search
CPC ..... B65H 2404/611; B65H 2404/612; B65H 2406/311; B65H 2406/312; B65H 23/0322; B65H 23/035; B65H 23/0324; B41J 15/005
See application file for complete search history.

(56) References Cited

U.S. PATENT DOCUMENTS

| | | | | | |
|---|---|---|---|---|---|
| 5,820,007 | A * | 10/1998 | Crowley | B41J 11/0005 | 226/31 |
| 6,052,144 | A * | 4/2000 | Reyner | B41J 11/46 | 347/136 |
| 8,523,034 | B2 * | 9/2013 | Fuchs | B65H 20/32 | 226/118.4 |
| 9,463,943 | B2 * | 10/2016 | Kawakami | B41J 15/005 | |
| 2011/0205282 | A1 | 8/2011 | Houjou | | |

FOREIGN PATENT DOCUMENTS

| | | | |
|---|---|---|---|
| JP | 08-311782 | A | 11/1996 |
| JP | 2011-111286 | | 6/2011 |
| JP | 2011-173383 | A | 9/2011 |
| JP | 2011-173713 | A | 9/2011 |
| JP | 2013-107296 | A | 6/2013 |

* cited by examiner

TRANSPORTING DEVICE AND PRINTING APPARATUS

BACKGROUND

1. Technical Field

The present invention relates to a transporting device and a printing apparatus.

2. Related Art

Among printing apparatuses, there is a printing apparatus which consecutively performs printing while transporting a belt-shaped printing base material which is also called a web (for example, refer to the following JP-A-8-311782). In such a printing apparatus, a transporting speed or tension of the printing base material is controlled and the printing base material is transported in a longitudinal direction by a plurality of rollers. In the technology of JP-A-8-311782, by providing a section in which the printing base material is loosened and transported, it is possible to adjust the transporting speed of the printing base material between configuration portions.

However, in the technology of JP-A-8-311782, there is a possibility that the printing base material is not sufficiently supported in a transporting roller on a downstream side of the section in which the printing base material is loosened, and a defect, such as generation of wrinkles on the printing base material, is generated. In this manner, in the printing apparatus, there is still room for improvement by improving properties that support the printing base material by the transporting roller.

SUMMARY

The invention can be realized in the following aspects.

[1] According to a first aspect of the invention, a transporting device which transports a belt-shaped base material by considering a longitudinal direction of the base material as a transporting direction is provided. The transporting device includes a first driving roller, a second driving roller, a driven roller, and an inter-roller transporting path. The first driving roller can transport the base material in the transporting direction by winding the base material and rotating. The second driving roller is disposed to be closer to a downstream side of the transporting direction than the first driving roller, and can transport the base material in the transporting direction by winding the base material and rotating. The driven roller can nip the base material between the second driving roller and the driven roller, and rotate together with the second driving roller. The inter-roller transporting path is provided between the first driving roller and the second driving roller, and can transport the base material in a state where the base material is suspended in a direction of gravity and bent. The second driving roller starts winding the base material at a position which is closer to an upstream side of the transporting direction than a position where the driven roller is in contact with the base material. According to the transporting device of the aspect, properties that support the base material in the second driving roller which receives the bent base material on the inter-roller transporting path and the driven roller, are improved. In addition, by providing the inter-roller transporting path through which the base material is transported in a bent state, control of tension of the base material or control of a transporting speed becomes easy.

[2] In the transporting device according to the aspect, a first suction portion which suctions the base material from a roller contact surface side which is a surface on a side that comes into contact with the second driving roller on the base material, may further be provided between a top of bending of the base material on the inter-roller transporting path and the second driving roller. According to the transporting device of the aspect, since it is possible to displace the base material to the second driving roller side in front of the second driving roller, it is possible to improve the properties that support the base material by the second driving roller.

[3] In the transporting device according to the aspect, the first suction portion may suction the base material in a state of not being in contact with the base material. According to the transporting device of the aspect, damage of the base material due to contact with the first suction portion is suppressed.

[4] In the transporting device according to the aspect, the first suction portion may generate negative pressure in a region which faces the roller contact surface by generating an air flow along the roller contact surface of the base material, and suction the base material. According to the transporting device of the aspect, it is possible to improve the properties that support the base material with respect to the second driving roller, and to ensure properties to protect the base material, by the suction force caused by the first suction portion.

[5] In the transporting device according to the aspect, the driven roller may press the base material at a part on both sides in a direction which intersects with the transporting direction of a predetermined region which extends in the transporting direction of the base material. According to the transporting device of the aspect, it is possible to improve the properties that protect the predetermined region on the base material.

[6] In the transporting device according to the aspect, a first guide portion which regulates a position shift of the base material in the direction which intersects with the transporting direction may be disposed at an inlet through which the base material is guided between the second driving roller and the driven roller. According to the transporting device of the aspect, since the position shift of the base material when the base material is guided between the second driving roller and the driven roller is suppressed, it is possible to improve the properties that support and protect the base material.

[7] In the transporting device according to the aspect, a tension applying portion which has a wall portion that is disposed to surround a bent part of the base material on the inter-roller transporting path, suctions the base material stored in a space surrounded by the wall portion in the direction of gravity, and applies tension to the base material, may further be provided. According to the transporting device of the aspect, since the tension is applied to the base material on the inter-roller transporting path, the properties that support the base material by the first driving roller and the driven roller, or the properties that support the base material by the second driving roller, are improved.

[8] In the transporting device according to the aspect, a suction force in the first suction portion may be smaller than a suction force in the tension applying portion. According to the transporting device of the aspect, more appropriate tension is applied to the base material on the inter-roller transporting path.

[9] In the transporting device according to the aspect, a second suction portion which suctions the base material from the roller contact surface side of the base material between the first driving roller on the inter-roller transporting path and the top of the bending of the base material, may further be provided. According to the transporting device of the aspect, it is possible to displace the base material to the first driving roller side, and to improve the properties that support the base material by the first driving roller.

[10] In the transporting device according to the aspect, a first driven roller, and a second driven roller which is the driven roller, may further be provided. The first driven roller may nip the base material between the first driving roller and the first driven roller, and rotate together with the first driving roller. The second driving roller may be at a higher position in the direction of gravity than the first driven roller. According to the transporting device of the aspect, it is possible to improve the properties that support the base material in the first driving roller by the first driven roller. In addition, as the second driving roller is at a high position, it is possible to improve the properties that support the base material in the second driving roller.

[11] In the transporting device according to the aspect, a second guide portion which regulates the position shift of the base material in the direction which intersects with the transporting direction may be disposed at an outlet through which the base material is fed out between the first driving roller and the first driven roller. According to the transporting device of the aspect, since the position shift when the base material is fed out between the first driving roller and the first driven roller is suppressed, it is possible to further improve the properties that support and protect the base material.

[12] According to a second aspect of the invention, a printing apparatus which forms a printed image on a belt-shaped printing base material is provided. The printing apparatus includes the transporting device according to any one of the above-described aspects which transports the printing base material as the base material. According to the printing apparatus of the aspect, the properties that support the printing base material while being transported are improved, and the printing base material and the printed image formed on the printing base material are protected.

A plurality of configuration elements which have each aspect of the above-described invention are not essential, and in order to solve a part or the entirety of the above-described problem, or in order to achieve a part or the entirety of the above-described effect described in the specification, it is possible to change, eliminate, and replace a part of the configuration elements among the plurality of configuration elements with another new configuration element, and to perform partial elimination of the limited contents. In addition, in order to solve a part or the entirety of the above-described problem, or in order to achieve a part or the entirety of the above-described effect described in the specification, it is possible to combine a part or the entirety of technical characteristics included in one aspect of the above-described invention with a part or the entirety of technical characteristics included in another aspect of the above-described invention, and to make another aspect as one independent aspect of the invention.

The invention can be realized in various aspects other than the transporting device and the printing apparatus. For example, the invention can be realized in aspects of a transporting method or a printing method, a control method of a transporting device or a printing apparatus, a computer program for realizing these methods, or a recording medium which is not temporary and has the computer program recorded therein.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment:

Entire Configuration of Printing Apparatus

Figure 1:
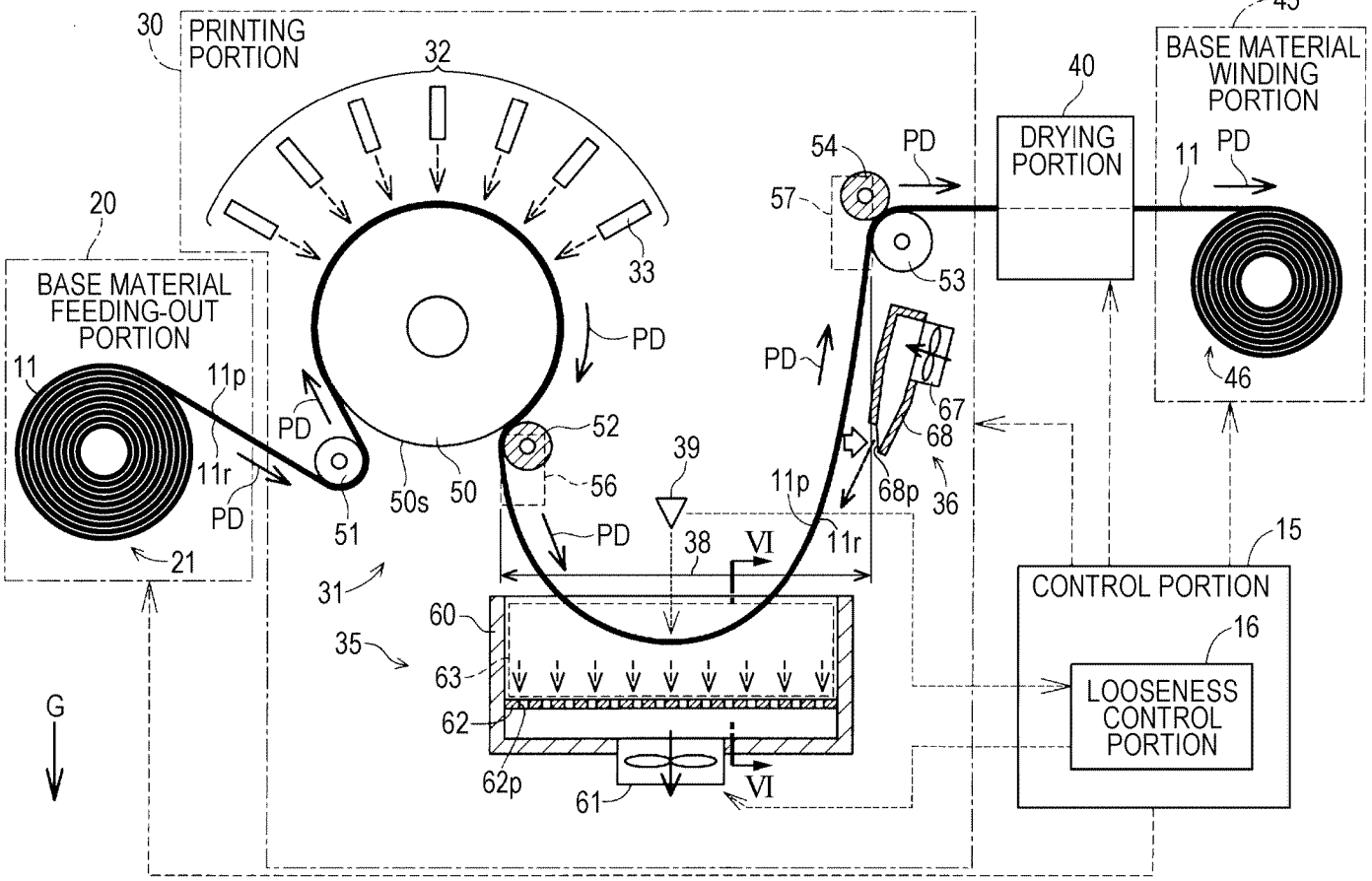
FIG. 1 is a schematic view illustrating a configuration of a printing apparatus of a first embodiment.

FIG. 1 is a schematic view illustrating a configuration of a printing apparatus 10 as a first embodiment of the invention. In FIG. 1, an arrow G illustrating a direction of gravity is illustrated. The arrow G illustrating the direction of gravity is similarly illustrated even in each drawing referred in the following description. In addition, in the specification, an "upper side" means an upper direction when considering the direction of gravity as a reference, and a "lower side" means a lower direction when considering the direction of gravity as a reference.

The printing apparatus 10 of the embodiment is an ink jet type line printer which performs consecutive printing while transporting a belt-shaped printing base material 11 by considering a longitudinal direction thereof as a transporting direction. The "transporting direction" in the specification means a direction in which the printing base material 11 is sent when a printed image is formed on the printing base material 11 in the printing apparatus 10. In addition, "upstream" in the specification means a starting point side in the transporting direction, and "downstream" means a terminal point side in the transporting direction. In FIG. 1, arrows PD illustrating the transporting direction appropriately illustrate a plurality of locations. The arrows PD illustrating the transporting direction are illustrated in each drawing referred in the following description.

The printing apparatus 10 includes a control portion 15, a base material feeding-out portion 20, a printing portion 30, a drying portion 40, and a base material winding portion 45. The control portion 15 is configured of a microcomputer which is provided with a central processing unit and a main memory unit. The control portion 15 controls each of the configuration portions 20, 30, 40, and 45 of the printing apparatus 10, and performs printing processing based on printing data received from the outside. In the embodiment, the control portion 15 has a function as a looseness control portion 16 which controls a level of looseness of the printing base material 11 in the printing portion 30 (the function will be described in detail later).

The base material feeding-out portion 20 is provided with a base material roller 21. The printing base material 11 is wound in a rolled shape around the base material roller 21. The base material roller 21 rotates by a motor (not illustrated) of which a rotating speed is controlled by the control portion 15. The base material feeding-out portion 20 feeds out the printing base material 11 which is wound around the base material roller 21 to the printing portion 30. The type of the printing base material 11 is not particularly limited, but for example, glossy paper, coating paper, or an OHP film may be used. In addition, ink jet paper, plain paper, Japanese paper, or cloth may also be used.

The printing portion 30 includes a base material transporting portion 31, an image forming portion 32, a tension applying portion 35, and a base material suction portion 36, and forms the printed image with respect to the printing base material 11. The base material transporting portion 31 is provided with a rotating drum 50, an inlet auxiliary roller 51, a first driven roller 52, a driving roller 53, and a second driven roller 54, as rollers which configure a transporting path of the printing base material 11 inside the printing portion 30. The configuration of the transporting path of the printing base material 11 which is configured of the base material transporting portion 31 will be described later.

The image forming portion 32 has a plurality of printing heads 33, and forms the printed image on a printing surface 11*p* of the printing base material 11 by discharging ink from each printing head 33. The image forming portion 32 corresponds to a recording portion. In the printing apparatus 10 of the embodiment, water-based ink is used. Different colors of ink are allocated in each printing head 33. Each printing head 33 is a so-called line head, and has a nozzle for discharging the ink arranged in a width direction of the printing base material 11. The "width direction of the printing base material 11" is a direction which is orthogonal to the longitudinal direction in which the printing base material 11 extends in a shape of a belt, and is also a direction which intersects with the transporting direction of the printing base material 11.

The image forming portion 32 forms the printed image on the printing base material 11 by using the rotating drum 50 as a so-called platen. In the embodiment, the printing base material 11 is transported being wound around a circumferential side surface 50*s* of the rotating drum 50 (this will be described in detail later). Above the rotating drum 50, each printing head 33 is arranged along the circumferential side surface 50*s* of the rotating drum 50, and discharges the ink toward the printing base material 11 on the rotating drum 50.

Each of the tension applying portion 35 and the base material suction portion 36 is provided at a section (to be described later) which is in a state where the printing base material 11 is bent on the transporting path of the printing base material 11 configured of the base material transporting portion 31. The tension applying portion 35 and the base material suction portion 36 improve the properties that support the printing base material 11 which is in a bent state. The tension applying portion 35 and the base material suction portion 36 will be described in detail later. The printing base material 11 on which the printed image is formed in the printing portion 30 is transported to the drying portion 40.

The drying portion 40 is provided with a heating device, such as a warm air heater. As described above, the printed image is formed by the water-based ink in the printing apparatus 10 of the embodiment, and there is case where it takes time to dry the ink. The drying portion 40 heats the printing base material 11 which is being transported to more completely dry the ink adhered to the printing base material 11. The printing base material 11 dried in the drying portion 40 is transported to the base material winding portion 45.

The base material winding portion 45 is provided with a winding roller 46 which is driven to rotate at a predetermined rotating speed in accordance with a command of the control portion 15. The base material winding portion 45 winds the printing base material 11 which is sent out from the drying portion 40 by the winding roller 46.

Transporting Mechanism in Printing Portion

1. Outline

Hereinafter, in addition to FIG. 1, a transporting mechanism of the printing base material 11 in the printing portion 30 of the embodiment will be described in order of the rotating drum 50, the inlet auxiliary roller 51, the first driven roller 52, the driving roller 53, and the second driven roller 54, with reference to FIGS. 2 to 6. In the embodiment, there is a section where the printing base material 11 is transported in a bent state (FIG. 1). A function of the section will be described together with the description of the driving roller 53. The tension applying portion 35 and the base material suction portion 36 will be described after the description of the driving roller 53.

2. Rotating Drum

Since the rotating drum 50 (FIG. 1) functions as a platen of the image forming portion 32 as described above, the rotating drum 50 has a diameter which is greater than diameters of the other rollers 51 to 54. In addition, the length of the rotating drum 50 in a direction of a rotation axis is greater than the width of the printing base material 11. The rotating drum 50 corresponds to a first driving roller in the invention, and rotates by the motor (not illustrated) of which the rotating speed is controlled by the control portion 15.

A rear surface 11*r* on a side opposite to the printing surface 11*p* of the printing base material 11 comes into surface-contact with the circumferential side surface 50*s*, and the rotating drum 50 transports the printing base material 11 as being rotated in a state where the printing base material 11 is wound around the circumferential side surface 50*s*. An expression that the belt-shaped base material is "wound around" in the specification means that the base material is in a state of being curved along a front surface of a target object, such as a side surface of a roller or the like, and in a slightly surface-contact state.

3. Inlet Auxiliary Roller

The inlet auxiliary roller 51 is disposed on an upstream side of the rotating drum 50. The inlet auxiliary roller 51 is disposed so that a rotation axis thereof is disposed to be positioned to be lower than the rotation axis of the rotating drum 50 in the direction of gravity. The printing base material 11 which is sent out from the base material feeding-out portion 20 is wound around the rotating drum 50 after being wound around the inlet auxiliary roller 51, and is transported in a state of being stretched between the inlet auxiliary roller 51 and the rotating drum 50, that is, in a state where tension is applied. The length of the inlet auxiliary roller 51 in the direction of the rotation axis is greater than the width of the printing base material 11, and the circumferential side surface thereof comes into contact with the entire printing surface 11*p* in the printing base material 11. According to this, generation of wrinkles on the printing base material 11 when the printing base material 11 is wound around the rotating drum 50 is suppressed.

4. First Driven Roller

Figure 2:
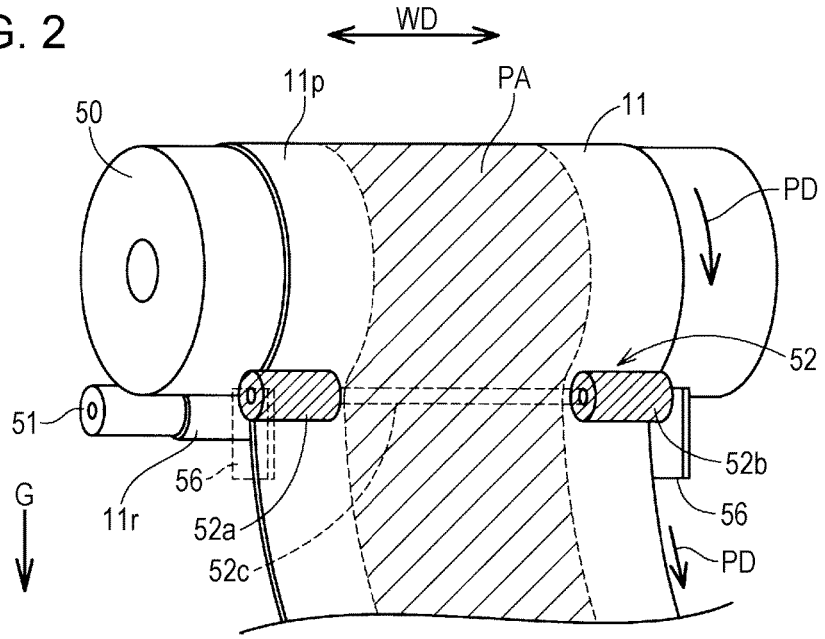
FIG. 2 is a schematic perspective view illustrating a rotating drum and a first driven roller.

FIG. 2 is a schematic perspective view illustrating the rotating drum 50 and the first driven roller 52. In FIG. 2, an arrow WD illustrating the width direction of the printing base material 11 is illustrated. In addition, in FIG. 2, a printable region PA which is a region (that is, a region in which each printing head 33 discharges the ink) in which the image forming portion 32 can form the printed image on the printing base material 11 is illustrated by hatching on the printing surface 11*p* of the printing base material 11.

The first driven roller 52 has two roller portions 52*a* and 52*b* which are separated from each other in the width direction of the printing base material 11. The two roller portions 52*a* and 52*b* are linked to each other by a common rotation axis portion 52*c* (for convenience, illustrated with dashed lines). The first driven roller 52 is disposed at a position adjacent to the rotating drum 50 on the downstream side of the rotating drum 50. The two roller portions 52*a* and 52*b* of the first driven roller 52 rotate together with the rotating drum 50 in a state where the printing base material 11 is nipped between the rotating drum 50 and the first driven roller 52.

The first driven roller 52 functions as a nipping roller which presses the printing base material 11 on the downstream side of the rotating drum 50 by the two roller portions 52*a* and 52*b*. According to this, the properties that support the printing base material 11 are improved on the circumferential side surface 50*s* of the rotating drum 50, and the generation of wrinkles on the printing base material 11 is suppressed. In particular, in the embodiment, as a terminal position of the winding of the printing base material 11 with respect to the rotating drum 50 is regulated by the first driven roller 52, the properties that support the printing base material 11 by the rotating drum 50 are improved (this will be described later).

In the embodiment, two roller portions 52*a* and 52*b* are disposed on both sides of the printable region PA in the width direction of the printing base material 11. According to this, the undried ink of the printing base material 11 is adhered to the roller portions 52*a* and 52*b*, and contamination of the printing surface 11*p* of the printing base material 11 is suppressed. In addition, generation of a recessed portion (a so-called nip mark) on the front surface of the printable region PA on the printing base material 11 as the roller portions 52*a* and 52*b* are pressed (nipped) is suppressed.

In the embodiment, guide plates 56 are installed on both outer sides of the two roller portions 52*a* and 52*b* in the width direction of the printing base material 11. In FIG. 2, one of the guide plates 56 is illustrated with a dashed line for convenience. The printing base material 11 is guided to regulate a position shift of the printing base material 11 in the width direction at an outlet from which the printing base material 11 is sent out between the rotating drum 50 and the first driven roller 52, by the guide plates 56.

Figure 3:
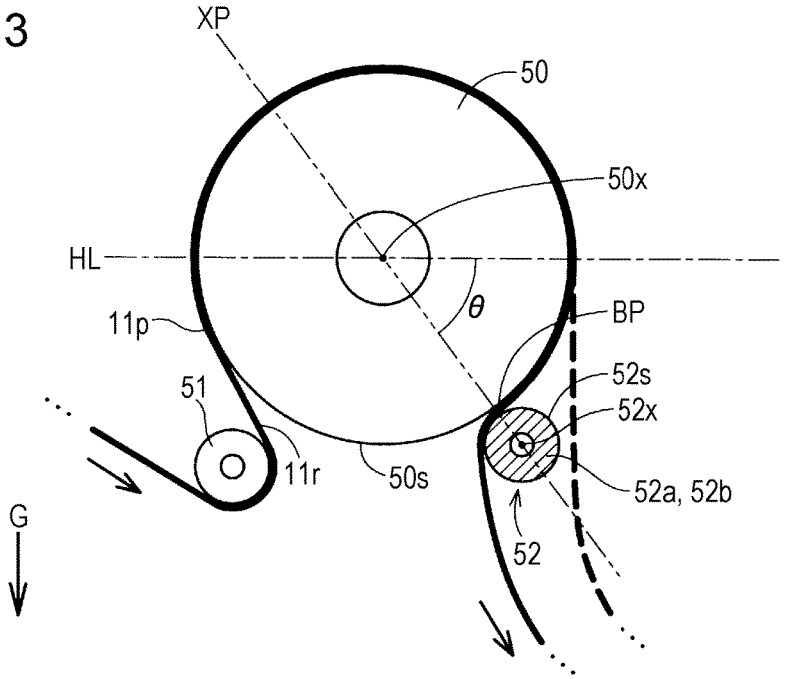
FIG. 3 is a schematic view illustrating a state where a printing base material is wound around the rotating drum by the first driven roller.

FIG. 3 is a schematic view illustrating a state where the printing base material 11 is wound around the rotating drum 50 by the first driven roller 52. In FIG. 3, the first driven roller 52, the rotating drum 50, the inlet auxiliary roller 51, and the printing base material 11 are illustrated when viewed in parallel to a rotation axis 52*x* of the first driven roller 52. In addition, in FIG. 3, a horizontal line HL which passes a rotation axis 50*x* of the rotating drum 50 is illustrated with a one-dot chain line, and a straight line which indicates a virtual plane XP which passes the rotation axis 50*x* of the rotating drum 50 and the rotation axis 52*x* of the first driven roller 52 is illustrated with a two-dot chain line. In addition to this, in FIG. 3, a position through which the printing base material 11 passes is illustrated with a dashed line in a case where the first driven roller 52 is omitted.

The rotation axis 52*x* of the first driven roller 52 is positioned below the rotation axis 50*x* of the rotating drum 50. More specifically, the rotation axis 52*x* of the first driven roller 52 is at a position of an angle θ (θ>0) in a clockwise direction around the rotation axis 50*x* of the rotating drum 50 with respect to the horizontal line HL.

As will be described later, in the embodiment, the tension to the printing base material 11 is released once on the downstream of the first driven roller 52, and the printing base material 11 is loosened in the direction of gravity. For this reason, as the first driven roller 52 is disposed at the above-described position, the printing base material 11 starts to be wound around the circumferential side surface 52*s* of each of the roller portions 52*a* and 52*b* in the first driven roller 52 by considering a boundary position BP between the rotating drum 50 and the first driven roller 52 on the virtual plane XP as a starting point.

When the first driven roller 52 is omitted, the printing base material 11 is separated from the rotating drum 50 in an end portion in a direction of the horizontal line HL of the circumferential side surface 50*s* of the rotating drum 50 as illustrated with a dashed line, and is suspended in the direction of gravity. In this manner, in the embodiment, the printing base material 11 is wound around the rotating drum 50 up to a contact position between the first driven roller 52 and the rotating drum 50. In other words, it is possible to interpret that the first driven roller 52 regulates the terminal position of the winding of the printing base material 11 in the transporting direction in the rotating drum 50.

In the embodiment, the first driven roller 52 regulates the terminal position of the winding of the printing base material 11 in the transporting direction in the rotating drum 50 to be positioned below the rotation axis 50*x* of the rotating drum 50. According to this, since the length by which the printing base material 11 is wound around the rotating drum 50 increases, the properties that support the printing base material 11 by the rotating drum 50 are improved. In addition, since a region which can be used as a platen on the circumferential side surface 50*s* of the rotating drum 50 is ensured, it is easy to reduce the diameter of the rotating drum 50.

5. Driving Roller

The driving roller 53 (FIG. 1) is disposed on the downstream side of the first driven roller 52. The length of the driving roller 53 in the direction of the rotation axis is sufficiently greater than the width of the printing base material 11. The printing base material 11 is supported by the driving roller 53 across the entire width direction. The driving roller 53 is rotated by the motor (not illustrated) of which the rotating speed is controlled by the control portion 15. The driving roller 53 winds the printing base material 11 to come into contact with the rear surface 11*r* of the printing base material 11, and transports the printing base material 11. The driving roller 53 corresponds to a second driving roller in the invention.

In the embodiment, the control portion 15 makes the printing base material 11 loosened and makes the printing base material 11 to be in state of being suspended in the direction of gravity and bent, between the rotating drum 50 and the driving roller 53, by temporarily decreasing the rotating speed of the driving roller 53 to be lower than that of the rotating drum 50. Hereinafter, the section in which the printing base material 11 is transported in a state of being loosened, being suspended in the direction of gravity, and being bent between the rotating drum 50 and the driving roller 53 is particularly called an "inter-roller transporting path 38".

On the inter-roller transporting path 38 which makes the printing base material 11 loosened, by cutting the tension applied to the printing base material 11, the influence of the tension applied to the printing base material 11 on a side which is further downstream than the driving roller 53, upon the tension applied to the printing base material 11 on a side which is further upstream side than the driving roller 53, is suppressed. Therefore, it is possible to separately perform control of a transporting speed of the printing base material 11 in the printing portion 30 and control of a transporting speed of the printing base material 11 in the drying portion 40 which is positioned downstream of the printing portion 30, and the transporting control of the printing base material 11 on the downstream side of the printing portion 30 becomes easy.

In addition, as the inter-roller transporting path 38 which makes the printing base material 11 loosened is provided, it is possible to easily configure the transporting path so that the printing base material 11 is guided to a position which is separated from the rotating drum 50 in a horizontal direction on the downstream side of the rotating drum 50. For this reason, it becomes easy to separately provide the drying portion 40 at a rear position of the printing portion 30 in the horizontal direction, as illustrated in FIG. 1. By separately laying out the drying portion 40 at the rear position of the printing portion 30 in the horizontal direction, it is possible to protect the printing portion 30 from the heat of the drying portion 40.

In the embodiment, a detection sensor 39 which detects the position of the top of the bending of the printing base material 11 is provided on the inter-roller transporting path 38. The detection sensor 39 is configured of an optical distance sensor which is provided with a light-emitting element and a light-receiving element, for example. The detection sensor 39 sends an electric signal which illustrates a variation amount of a height position in the direction of gravity of the top of the bending in the printing base material 11, to the control portion 15. The looseness control portion 16 of the control portion 15 controls the rotating speed of the driving roller 53 and a suction force in the tension applying portion 35 so that the height position of the top of the bending of the printing base material 11 becomes a predetermined position on the inter-roller transporting path 38, based on an output result of the detection sensor 39 (this will be described later).

In the embodiment, the driving roller 53 is provided at a position which is higher than the rotating drum 50 and the first driven roller 52 in the direction of gravity. According to this, the length of the printing base material 11 which is wound around the driving roller 53 increases more than that when the driving roller 53 is at a low position. In addition, as the printing base material 11 moves by its own weight, the force which acts in a direction in which the printing base material 11 is wound around the driving roller 53 increases. Therefore, the properties that support the printing base material 11 by the driving roller 53 are improved.

In addition, by disposing the driving roller 53 at the position which is higher than the rotating drum 50, it is possible to easily lay out the drying portion 40 at the position which is higher than the rotating drum 50. By laying out the drying portion 40 at a high position, it is possible to protect the printing portion 30 from the heat of the air which is heated by the drying portion 40 and moves upward.

6. Second Driven Roller

Figure 4:
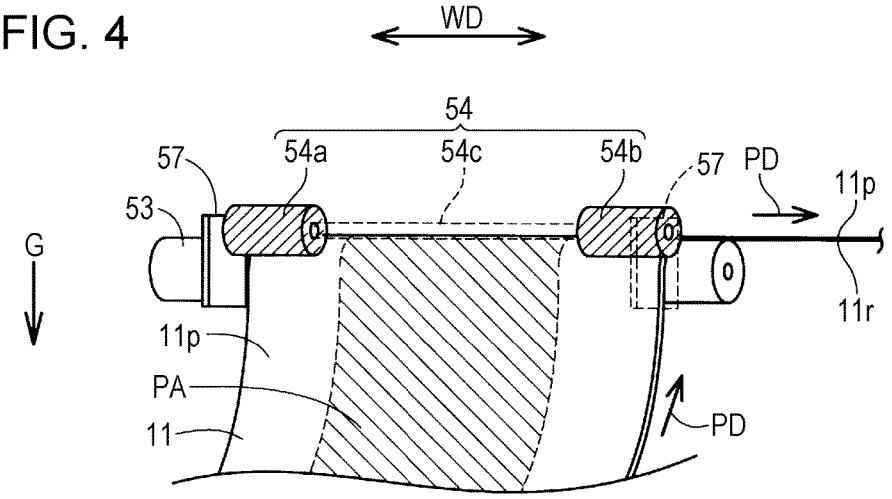
FIG. 4 is a schematic perspective view illustrating a driving roller and a second driven roller.
Figure 5:
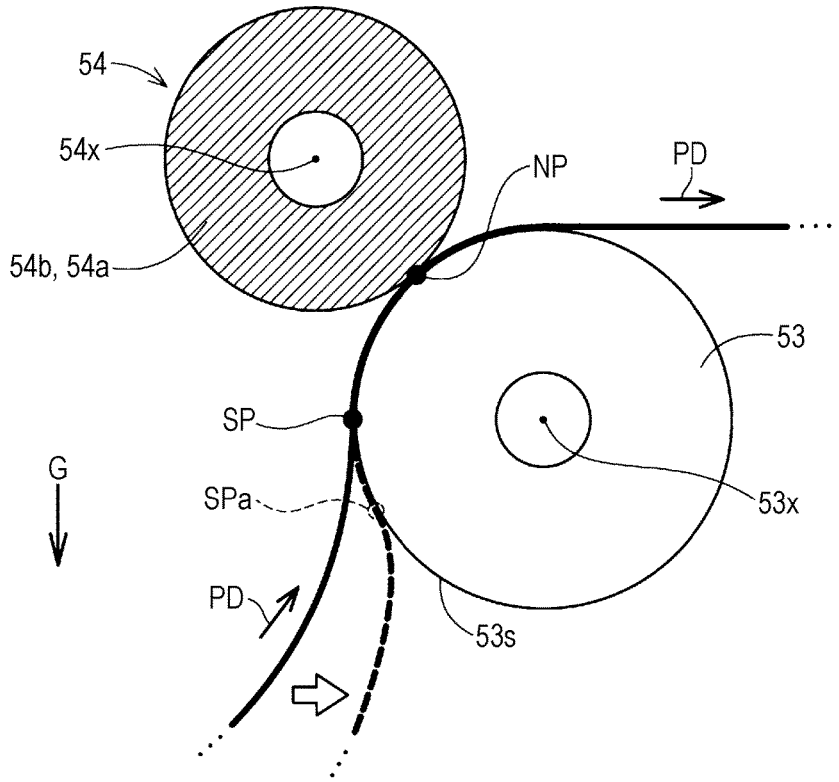
FIG. 5 is a schematic view illustrating a position where the second driven roller is disposed with respect to the driving roller.

The second driven roller 54 will be described with reference to FIGS. 4 and 5. FIG. 4 is a schematic perspective view illustrating the driving roller 53 and the second driven roller 54. In FIG. 4, an arrow WD illustrating the width direction of the printing base material 11, and the printable region PA in the printing base material 11, are illustrated similarly to FIG. 2. FIG. 5 is a schematic view illustrating position where the second driven roller 54 is disposed with respect to the driving roller 53. In FIG. 5, the driving roller 53, the second driven roller 54, and the printing base material 11 are illustrated when viewed in parallel to a rotation axis 54*x* of the second driven roller 54.

The second driven roller 54 includes two roller portions 54*a* and 54*b* which are separated from each other in the width direction of the printing base material 11 (FIG. 4). The two roller portions 54*a* and 54*b* are linked to each other by a common rotation axis portion 54*c* (illustrated with a dashed line). The two roller portions 54*a* and 54*b* of the second driven roller 54 rotate together with the driving roller 53 in a state where the printing base material 11 is nipped between the driving roller 53 and the second driven roller 54. The second driven roller 54 functions as a nipping roller which presses the printing base material 11 on the driving roller 53, and the properties that support the printing base material 11 are improved in the base material transporting portion 31.

In addition to this, in the embodiment, the rotation axis 54*x* of the second driven roller 54 is disposed to be positioned above a rotation axis 53*x* of the driving roller 53 (FIG. 5). In other words, the two roller portions 54*a* and 54*b* of the second driven roller 54 are disposed at a position of coming into contact with the printing base material 11 and pressing the printing base material 11, at a position NP which is closer to the downstream side than a position SP where the printing base material 11 starts to be wound on a circumferential side surface 53*s* of the driving roller 53.

According to this, after the printing base material 11 which is in a state of being likely to oscillate in the width direction on the inter-roller transporting path 38, is supported by the driving roller 53 in the width direction, the printing base material 11 is nipped by the second driven roller 54. In other words, the printing base material 11 is in a state where the position thereof is stabilized by the driving roller 53, and further, the printing base material 11 is pressed to the driving roller 53 by the second driven roller 54.

Therefore, when the printing base material 11 is fed in between the driving roller 53 and the second driven roller 54, a defect, such as generation of wrinkles on the printing base material 11, is suppressed. In particular, as in the embodiment, when the second driven roller 54 is configured to press the printing base material 11 by the two roller portions 54*a* and 54*b*, generation of wrinkles as the printing base material 11 floats up between the two roller portions 54*a* and 54*b* is suppressed.

In the embodiment, the two roller portions 54*a* and 54*b* of the second driven roller 54 are disposed on both sides of the printable region PA in the width direction of the printing base material 11 (FIG. 4). According to this, adhesion of the undried ink of the printing base material 11 to the roller portions 54*a* and 54*b*, contamination of the printing surface 11*p* of the printing base material 11, or generation of a nip mark on the front surface of the printing base material 11 due to the roller portions 54*a* and 54*b*, is suppressed.

Furthermore, in the embodiment, guide plates 57 are installed on both outer sides of the two roller portions 54*a* and 54*b* in the width direction of the printing base material 11. In FIG. 4, one of the guide plates 57 is illustrated with a dashed line for convenience. The position shift of the printing base material 11 in the width direction at the inlet through which the printing base material 11 is fed in between the driving roller 53 and the second driven roller 54 is suppressed by the guide plates 57.

7. Tension Applying Portion

The tension applying portion 35 is disposed below the printing base material 11 which is bent on the inter-roller transporting path 38 (FIG. 1). The tension applying portion 35 is provided with a base material storage portion 60 and a negative pressure generation portion 61. The base material storage portion 60 is configured in the shape of a box of which an upper side is opened. The bent part of the printing base material 11 from the opening portion on the upper side is stored inside the base material storage portion 60. The negative pressure generation portion 61 is provided below the base material storage portion 60, and negative pressure is generated inside the base material storage portion 60. The negative pressure generation portion 61 is configured of a suction fan or a suction blower, for example.

A distributing plate 62 is disposed inside the base material storage portion 60. In a region which faces the rear surface 11*r* of the printing base material 11 of the distributing plate 62, shower holes 62*p* which are micro through holes that are formed being dispersed in a predetermined pattern are provided. The distributing plate 62 spreads a flow of the air generated by the negative pressure generation portion 61 uniformly in the width direction and in the transporting direction of the printing base material 11 so that the suction force due to the negative pressure acts on the entire printing base material 11 stored in the base material storage portion 60 which will be described hereinafter. A movable type inner wall 63 is further disposed inside the base material storage portion 60. The movable type inner wall 63 will be described later.

The tension applying portion 35 generates the suction force which suctions the bent part of the printing base material 11 in the direction of gravity which is a bending direction thereof, and applies the tension in a non-contact state to the printing base material 11 by generating the negative pressure inside the base material storage portion 60 by the negative pressure generation portion 61. By applying the tension, the oscillation of the bent part of the printing base material 11 is suppressed, and the position shift of the printing base material 11 is suppressed. In addition to this, since the tension is applied in a non-contact state to the printing base material 11, damage of the printing base material 11 is suppressed.

The tension applied to the printing base material 11 by the tension applying portion 35 is regulated by the suction force in the negative pressure generation portion 61. The suction force in the negative pressure generation portion 61 is controlled by the looseness control portion 16 of the control portion 15. The looseness control portion 16 controls the rotating speed of the driving roller 53 and the suction force in the negative pressure generation portion 61 based on a detection result of the detection sensor 39 so that the top of the bending of the printing base material 11 becomes a predetermined height position on the inter-roller transporting path 38.

As will be described hereinafter, for example, the looseness control portion 16 may also combine and perform the control of the rotating speed of the driving roller 53 and the control of the suction force in the negative pressure generation portion 61. When the top of the bending of the printing base material 11 is at a position which is shifted from a regulated position by a predetermined variation width, the looseness control portion 16 controls the rotating speed of the driving roller 53, and displaces the top of the bending of the printing base material 11 up to a position within the predetermined variation width. In addition, the looseness control portion 16 performs fine adjustment so that the top of the bending of the printing base material 11 comes to the regulated height position by the suction force in the negative pressure generation portion 61.

Otherwise, the looseness control portion 16 may also perform the control by using a map or the like in which each of an adjustment amount of the rotating speed of the driving roller 53 with respect to the variation amount of the position of the top of the bending of the printing base material 11, and an adjustment amount of the suction force in the negative pressure generation portion 61, is uniquely set. In addition, the looseness control portion 16 may change the rotating speed of the driving roller 53 or the amount of controlling the suction force of the negative pressure generation portion 61 in accordance with a parameter which influences the bending of the printing base material 11, such as the thickness, rigidity, or density of the printing base material 11. In addition, it is desirable that the suction force of the negative pressure generation portion 61 is controlled so as to not be smaller than the suction force of the base material suction portion 36 (this will be described later).

In this manner, as the height position of the top of the bending of the printing base material 11 on the inter-roller transporting path 38 is controlled, excessive looseness of the printing base material 11 is suppressed. In addition, damage of the loosened part of the printing base material 11 due to the contact with the tension applying portion 35 is suppressed.

Figure 6:
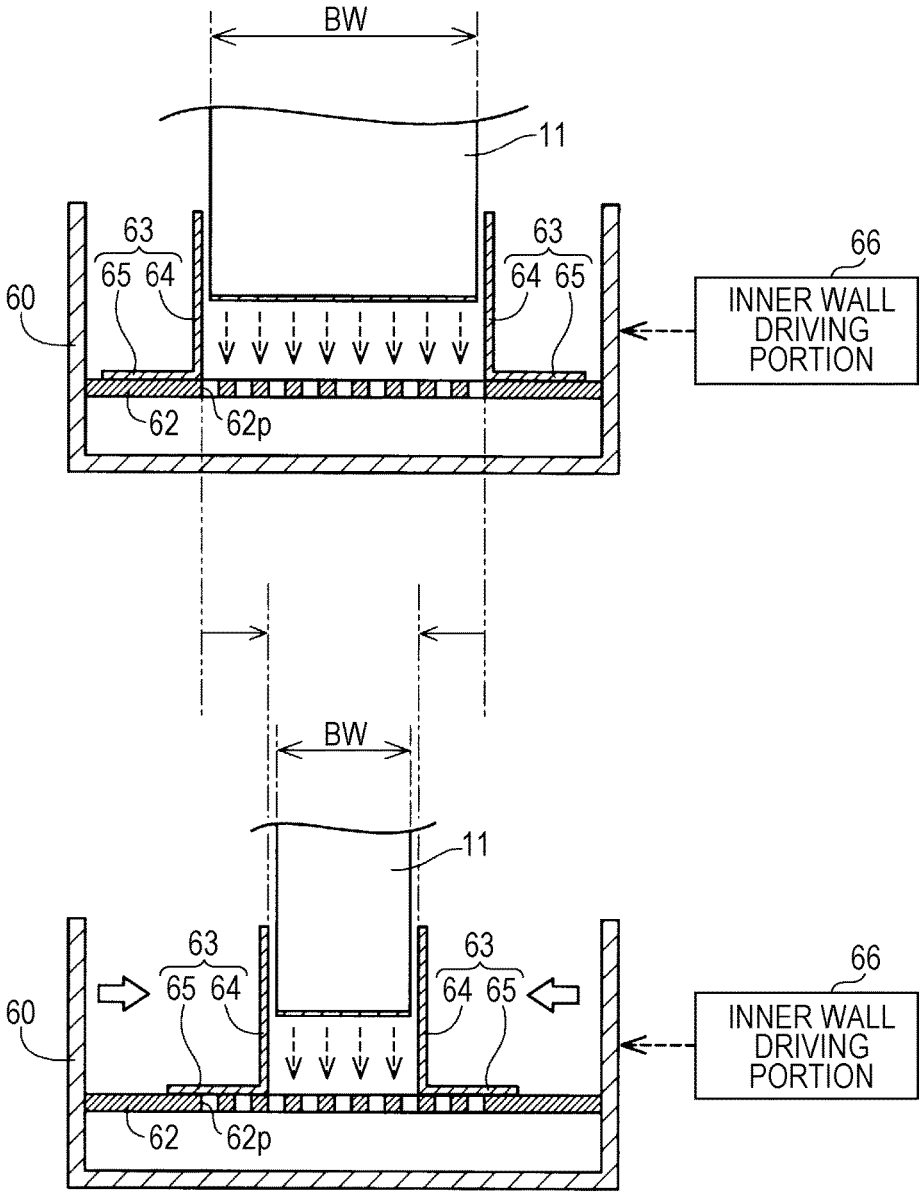
FIG. 6 is a schematic view illustrating a guide plate which is provided inside a base material storage portion.

FIG. 6 is a schematic view illustrating the movable type inner wall 63 which is provided inside the base material storage portion 60. On each of an upper part and a lower part of FIG. 6, a schematic sectional surface of the base material storage portion 60 at a position which corresponds to the cut along line VI-VI of FIG. 1 is illustrated. A state of the base material storage portion 60 when a width BW of the printing base material 11 is large is illustrated at the upper part of FIG. 6, and a state of the base material storage portion 60 when the width BW of the printing base material 11 is small is illustrated at the lower part of FIG. 6.

Inside the base material storage portion 60, two movable type inner walls 63 are disposed to nip the stored printing base material 11 in the width direction thereof. The two movable type inner walls 63 have a substantially L-shaped sectional surface, and include a plate-shaped side plate portion 64 which extends parallel to the direction of gravity, and a bottom plate portion 65 which is disposed parallel to an upper surface of the distributing plate 62. Each movable type inner wall 63 can be displaced in the width direction of the printing base material 11 on a relay portion (not illustrated) provided between the distributing plate 62 and the bottom plate portion 65.

Each movable type inner wall 63 is displaced in the width direction of the printing base material 11 in accordance with the width BW of the printing base material 11 by the driving force transferred from an inner wall driving portion 66 which is configured of the motor or the like, under the control of the control portion 15. When the width BW of the printing base material 11 is large (upper part of FIG. 6), the movable type inner wall 63 is displaced so that the distance between the two movable type inner walls 63 increases, and when the width BW of the printing base material 11 is small (lower part of FIG. 6), the movable type inner wall 63 is displaced so that the distance between the two movable type inner walls 63 decreases.

By adjusting the distance between the two movable type inner walls 63 by matching the width BW of the printing base material 11, an opening area of the base material storage portion 60 with respect to the width of the printing base material 11 becomes appropriate, and deterioration of suction efficiency due to the negative pressure generation portion 61 is suppressed. In addition, the bent part of the printing base material 11 is reliably guided by each side plate portion 64, and the properties that support the printing base material 11 on the inter-roller transporting path 38 are improved. In addition, it is desirable that the distance between the two movable type inner walls 63 ensures clearance to the extent that each side plate portion 64 does not come into contact with the printing base material 11.

8. Base Material Suction Portion

The base material suction portion 36 will be described with reference to FIGS. 1 and 5. The base material suction portion 36 is disposed in a region which faces the rear surface 11*r* of the printing base material 11 at a position which is closer to the downstream side than the top of the bending of the printing base material 11 on the inter-roller transporting path 38 (FIG. 1). The base material suction portion 36 is provided with an air blowing portion 67 and a nozzle portion 68. For example, the air blowing portion 67 is configured of an air blowing fan or an air blower. The amount of air blown by the air blowing portion 67 is controlled by the control portion 15. The nozzle portion 68 has a slit-shaped opening portion 68*p*, and ejects an air flow generated by the air blowing portion 67 from the opening portion.

The base material suction portion 36 is disposed so that the opening portion 68*p* of the nozzle portion 68 is opened obliquely downward on the rear surface 11*r* side of the printing base material 11 on the inter-roller transporting path 38, and the air flow generated by the air blowing portion 67 flows along the rear surface 11*r* of the printing base material 11. By the air flow, the negative pressure is generated in the region which faces the rear surface 11*r* of the printing base material 11, and the suction force which pulls the printing base material 11 to the base material suction portion 36 side is generated (Venturi effect).

According to this, the printing base material 11 is displaced to a position which is illustrated with dashed lines in FIG. 5, and the position where the printing base material 11 starts to be wound around the driving roller 53 moves to further upstream side (the lower side of the driving roller 53). In this manner, the base material suction portion 36 can increase the length by which the printing base material 11 is wound around the driving roller 53 by performing suction without coming into contact with the printing base material 11. Therefore, the properties that support the printing base material 11 and the transporting force which transports the printing base material 11 by the driving roller 53, are improved.

In addition, if the Venturi effect is used similarly for the base material suction portion 36 of the embodiment, excessive approach of the printing base material 11 to the nozzle portion 68 of the base material suction portion 36 is suppressed, and properties that protect the printing base material 11 are ensured. Additionally, since the air flow is applied to the rear surface 11*r* of the printing base material 11 in the base material suction portion 36, deterioration of the printed image due to the flow of the undried ink of the printing surface 11*p* by the air flow is suppressed.

It is desirable that the suction force of the printing base material 11 by the base material suction portion 36 is smaller than the suction force of the printing base material 11 by the tension applying portion 35. According to this, by the suction force of the base material suction portion 36, excessive approach of the printing base material 11 to the base material suction portion 36 is suppressed, and damage of the printing base material 11 due to the contact with the base material suction portion 36 is suppressed.

Conclusion of First Embodiment

As described above, according to the printing apparatus 10 of the first embodiment, the properties that support the printing base material 11 and the transporting force in the driving roller 53 on the downstream side of the inter-roller transporting path 38 are improved by the second driven roller 54 or the base material suction portion 36, and generation of a defect, such as generation of wrinkles on the printing base material 11 is suppressed. In addition, the properties that support the printing base material 11 in the rotating drum 50 or the first driven roller 52 are also improved. Furthermore, by providing the inter-roller transporting path 38, properties that control the transporting of the printing base material 11 are improved, and the properties that support and protect the printing base material 11 on the inter-roller transporting path 38 are improved by the tension applying portion 35 or the base material suction portion 36.

B. Second Embodiment:

A configuration of a printing portion 30A in a printing apparatus of a second embodiment will be described with reference to FIGS. 7 to 9. In the printing apparatus of the second embodiment, when transporting the printing base material 11 in the transporting direction, and when transporting the printing base material 11 in a direction reverse to the transporting direction, the configuration of the transporting mechanism in the printing portion 30A is changed. Hereinafter, for convenience, the transporting direction of the printing base material 11 when forming the printed image as described in the first embodiment is called a "first transporting direction", and a direction reverse to the first transporting direction is called a "second transporting direction". In addition, in the following description, the expressions "upstream" and "downstream" are not particularly stated, and mean directions which consider the first transporting direction as a reference, similar to the case of the first embodiment.

Figure 7:
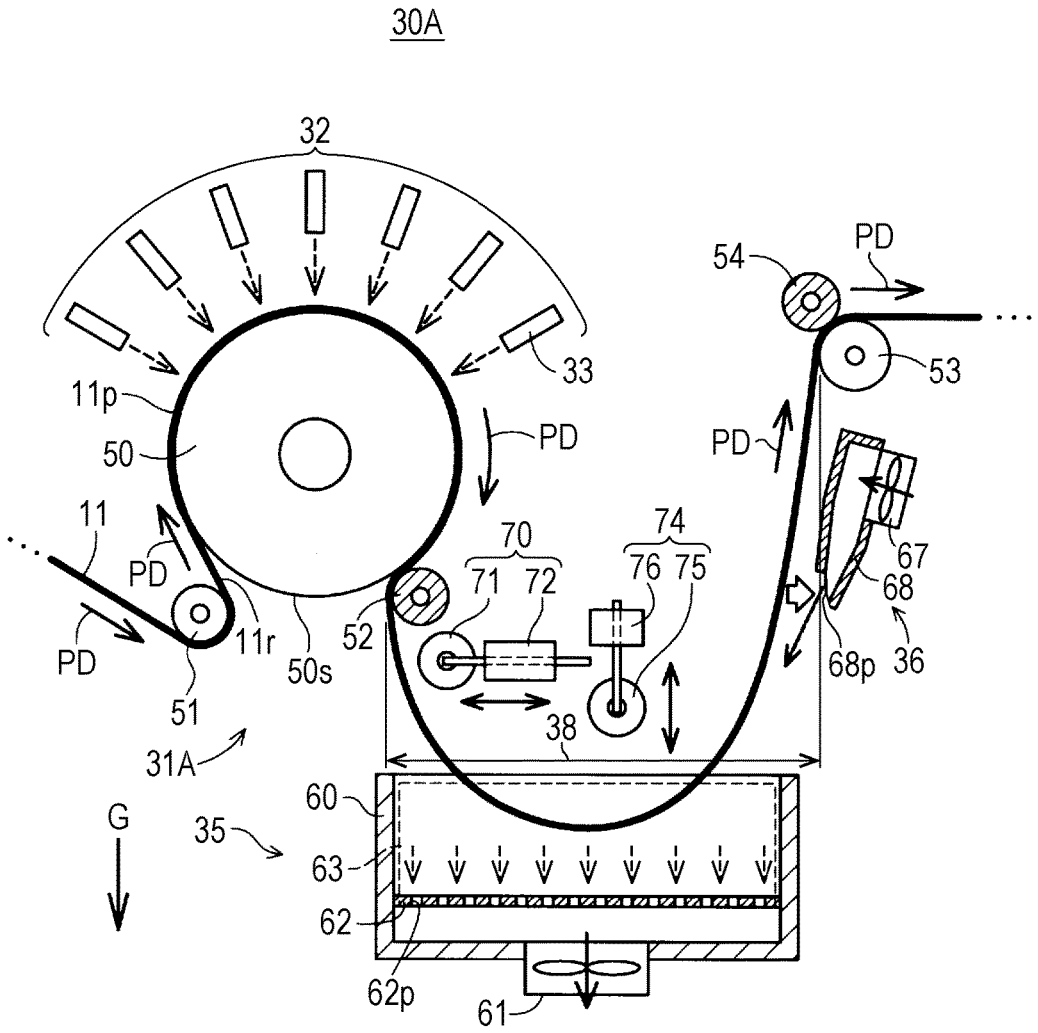
FIG. 7 is a schematic view illustrating a printing portion of a second embodiment when the printing base material is transported in a first transporting direction.
Figure 8:
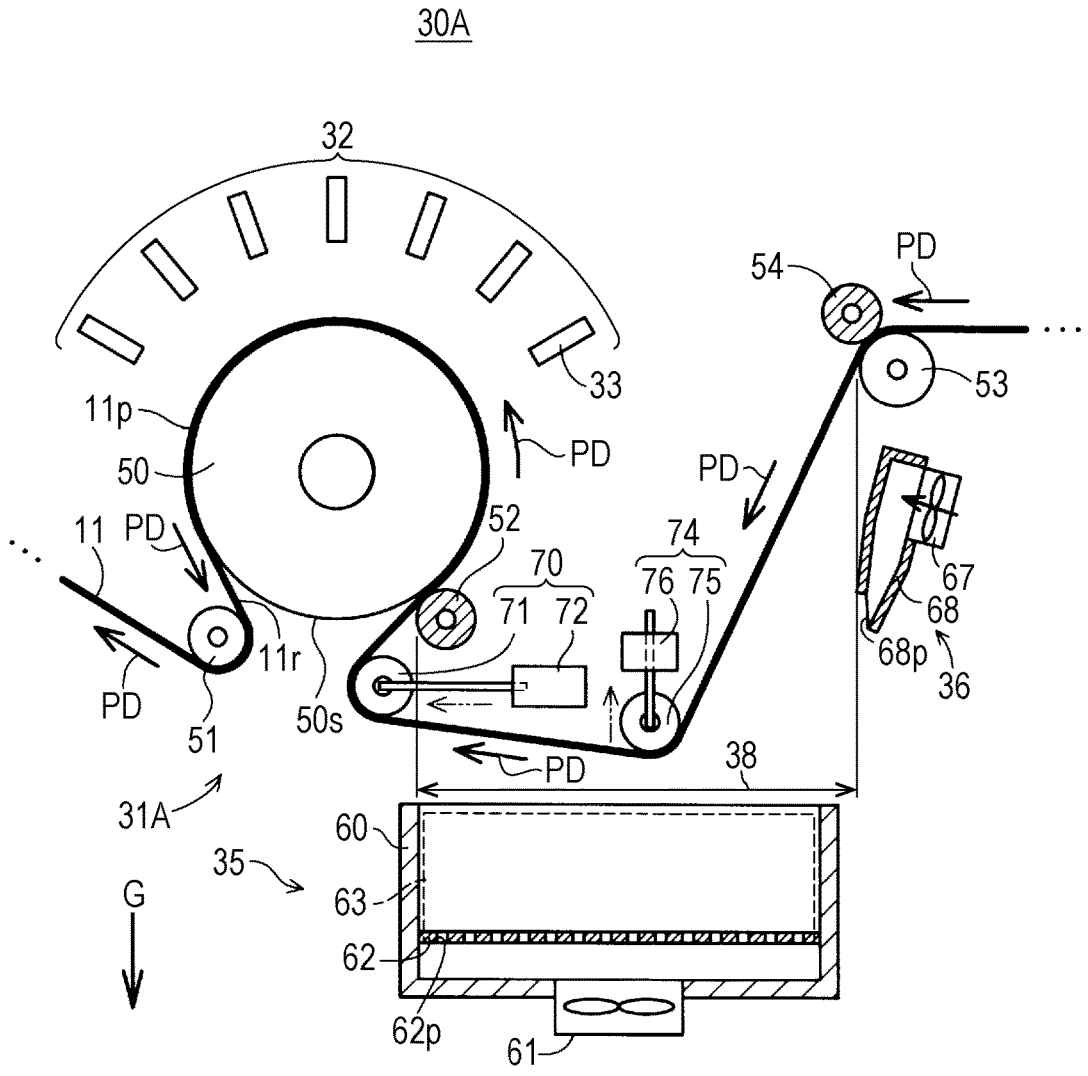
FIG. 8 is a schematic view illustrating the printing portion of the second embodiment when the printing base material is transported in a second transporting direction.

Each of FIGS. 7 and 8 illustrates the configuration of the printing portion 30A in the printing apparatus of the second embodiment. FIG. 7 illustrates the printing portion 30A when transporting the printing base material 11 in the first transporting direction. FIG. 8 illustrates the printing portion 30A when transporting the printing base material 11 in the second transporting direction. The printing apparatus of the second embodiment is substantially the same as the printing apparatus 10 (FIG. 1) of the first embodiment except that a displacement roller 70 and a tension adjustment roller 74 are added to a base material transporting path 31A of the printing portion 30A. In addition, in FIGS. 7 and 8, for convenience, the detection sensor 39 and the guide plates 56 and 57 are omitted.

In the printing apparatus of the second embodiment, when the printed image is formed on the printing surface 11*p* of the printing base material 11, the printing base material 11 is transported in the first transporting direction. There is a case where the printing base material 11 is transported in the second transporting direction when the position thereof is arranged, or when maintenance is performed with respect to the printing apparatus. In the printing portion 30A of the second embodiment, in order to improve the properties that support the printing base material 11 when the printing base material 11 is transported in the second direction, the displacement roller 70 and the tension adjustment roller 74 are provided in the base material transporting path 31A.

The displacement roller 70 (FIG. 7) is provided with a roller portion 71 and a power cylinder portion 72. The power cylinder portion 72 is configured of an actuator which is expanded and contracted on a straight line, for example, by hydraulic mechanism or a solenoid mechanism. The roller portion 71 is attached to a tip end of the power cylinder portion 72 to be rotatable, and is linearly displaced as the power cylinder portion 72 is driven to be expanded and contracted. In order to ensure the properties that support the printing base material 11, it is desirable that the length of the roller portion 71 in the direction of the rotation axis is greater than the width of the printing base material 11, and it is desirable that the roller portion 71 is in contact with the printing base material 11 across the entire region in the width direction of the printing base material 11.

The displacement roller 70 is disposed at a position which opposes the printing surface 11*p* of the printing base material 11, at a position which is closer to the upstream side than the top of the bending of the printing base material 11 on the inter-roller transporting path 38. In the embodiment, the displacement roller 70 is displaced so that the roller portion 71 is displaced in the horizontal direction at a position below the first driven roller 52.

The control portion 15 displaces the roller portion 71 to a first position and a second position by controlling the power cylinder portion 72 to be driven to be expanded and contracted. While the printing base material 11 is transported in the first transporting direction, the power cylinder portion 72 is in a contracted state, and the roller portion 71 is positioned at the first position which is separated from the printing base material 11 (FIG. 7). Meanwhile, while the printing base material 11 is transported in the second transporting direction, the power cylinder portion 72 is in an expanded state, and the roller portion 71 is positioned at the second position which comes into contact with the printing surface 11*p* of the printing base material 11 (FIG. 8). When the roller portion 71 is positioned at the second position, the roller portion 71 comes into contact with the entire printing base material 11 across the width direction of the printing base material 11.

Figure 9:
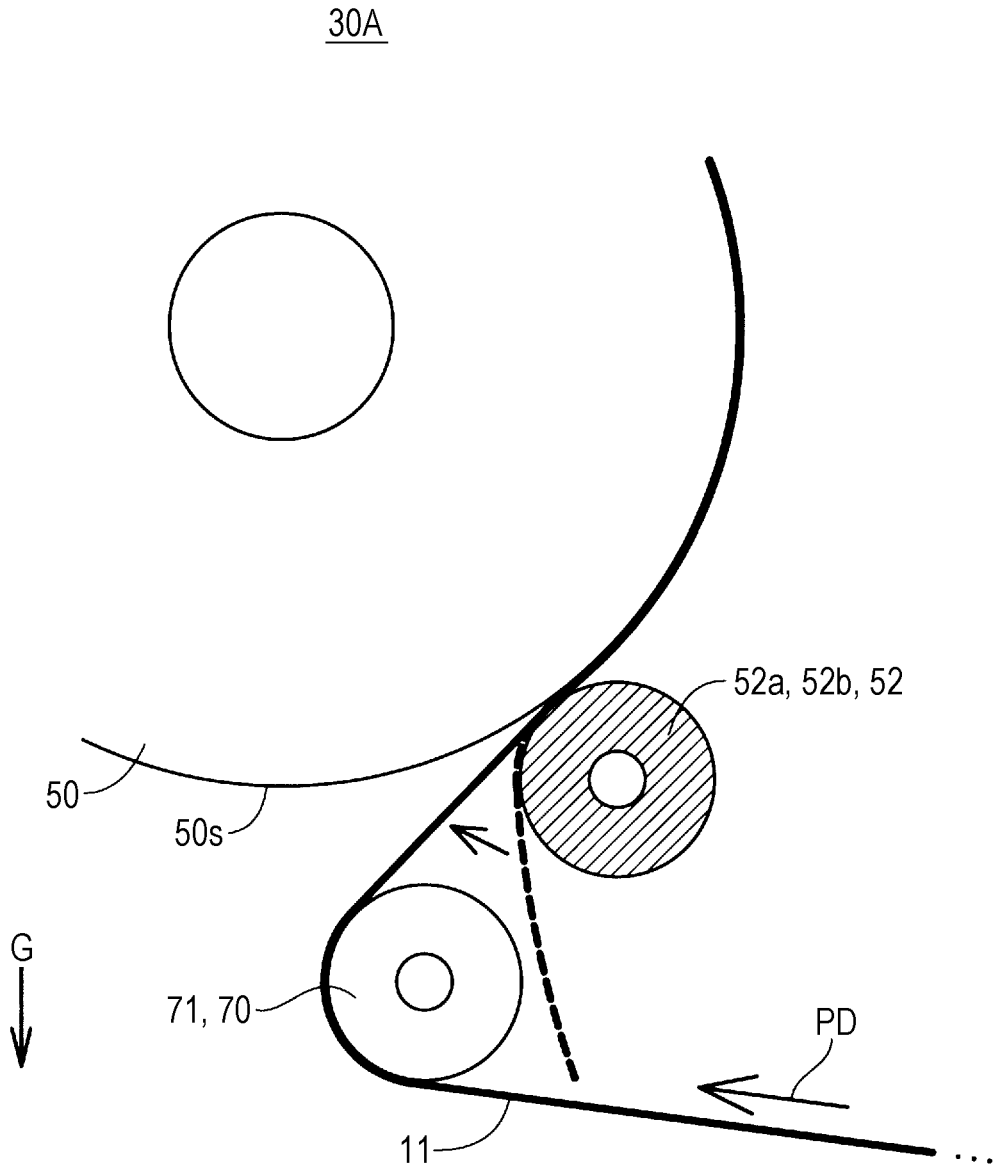
FIG. 9 is a schematic view illustrating a state of the printing base material when a roller portion of a displacement roller is positioned at a second position.

FIG. 9 is a schematic view illustrating a state of the printing base material 11 when the roller portion 71 of the displacement roller 70 is positioned at the second position. In FIG. 9, the position of the printing base material 11 which is being transported in the first transporting direction is illustrated with dashed lines. In addition, in FIG. 9, for convenience, the power cylinder portion 72 of the displacement roller 70 is not illustrated. As described above, when the printing base material 11 is transported in the second transporting direction, the roller portion 71 of the displacement roller 70 is displaced to the second position. At this time, the printing base material 11 is pressed by the roller portion 71, and is displaced in a direction of approaching the rotating drum 50, that is, in a direction of being separated from the first driven roller 52.

According to this, the range in which the printing base material 11 is wound around the first driven roller 52 is changed, and the length of the printing base material 11 by which the printing base material 11 is wound around the first driven roller 52 is decreased to be shorter than that when the printing base material 11 is transported in the first transporting direction. In the embodiment, the printing base material 11 is in a state of being almost not wound around the first driven roller 52. In this manner, when the printing base material 11 is transported in the second transporting direction, it is possible to interpret that the range in which the printing base material 11 is wound around the first driven roller 52 is regulated by the roller portion 71 of the displacement roller 70 which is positioned at the second position.

In the second embodiment, when the printing base material 11 is transported in the second direction, the printing base material 11 is fed in between the first driven roller 52 and the rotating drum 50 after the printing base material 11 is supported by the displacement roller 70. Therefore, generation of wrinkles on the printing base material 11 is more suppressed than that in a case where the printing base material 11 is directly fed in between the first driven roller 52 and the rotating drum 50 from a state of being bent on the inter-roller transporting path 38. In particular, generation of wrinkles due to the winding between the rotating drum 50 and the first driven roller 52 in a state where the printing base material 11 floats up between the two roller portions 52*a* and 52*b* of the first driven roller 52 is suppressed.

The tension adjustment roller 74 (FIG. 7) is disposed on the downstream side of the displacement roller 70 on the inter-roller transporting path 38. The tension adjustment roller 74 is provided with a roller portion 75 and a roller supporting portion 76. In the roller portion 75, it is desirable that the length in the direction of the rotation axis is greater than the width of the printing base material 11, and the roller portion 75 comes into contact with the printing base material 11 in the entire region in the width direction of the printing base material 11. The roller portion 75 is held at a position which opposes the printing surface 11*p* above the printing base material 11 by the roller supporting portion 76. For example, the roller supporting portion 76 is configured of an extensible arm, and is held to be displaceable in the direction of gravity when the roller portion 71 receives an outer force.

When the roller portion 71 of the displacement roller 70 is displaced to the second position and presses the printing base material 11, the roller portion 75 of the tension adjustment roller 74 is disposed at a position which can come into contact with the printing surface 11*p* of the printing base material 11 (FIG. 8). The roller portion 75 presses the printing base material 11 by its own weight downward in the direction of gravity into a state where the roller portion 75 comes into contact with the printing surface 11*p* of the printing base material 11. When the printing base material 11 is transported in the second transporting direction, the tension adjustment roller 74 functions as a so-called dancer roller. As the roller portion 75 of the tension adjustment roller 74 presses the printing base material 11, the printing base material 11 is in a state where the bending is released and the tension is applied. According to this, when transporting the printing base material 11 in the second transporting direction, the properties that support the printing base material 11 are improved, and the transporting speed of the printing base material 11 when transporting the printing base material 11 in the second transporting direction can be improved.

In the printing portion 30 of the second embodiment, it is possible to interpret that a first transporting process in which the printing base material 11 is transported in the first transporting direction in a bent state on the inter-roller transporting path 38, and a second transporting process in which the printing base material 11 is transported in the second transporting direction in a state where the tension is applied to the printing base material 11 and the bending of the printing base material 11 is released on the inter-roller transporting path 38, are performed. According to the printing portion 30A in the printing apparatus of the second embodiment, by providing the displacement roller 70 or the tension adjustment roller 74 which can apply the tension to the printing base material 11 when the transporting direction is reversed, the properties that support the printing base material 11 during the second transporting process are effectively improved. In addition to this, according to the printing apparatus of the second embodiment, it is possible to achieve an operation effect which is similar to that of the printing apparatus 10 of the first embodiment.

C. Third Embodiment

Figure 10:
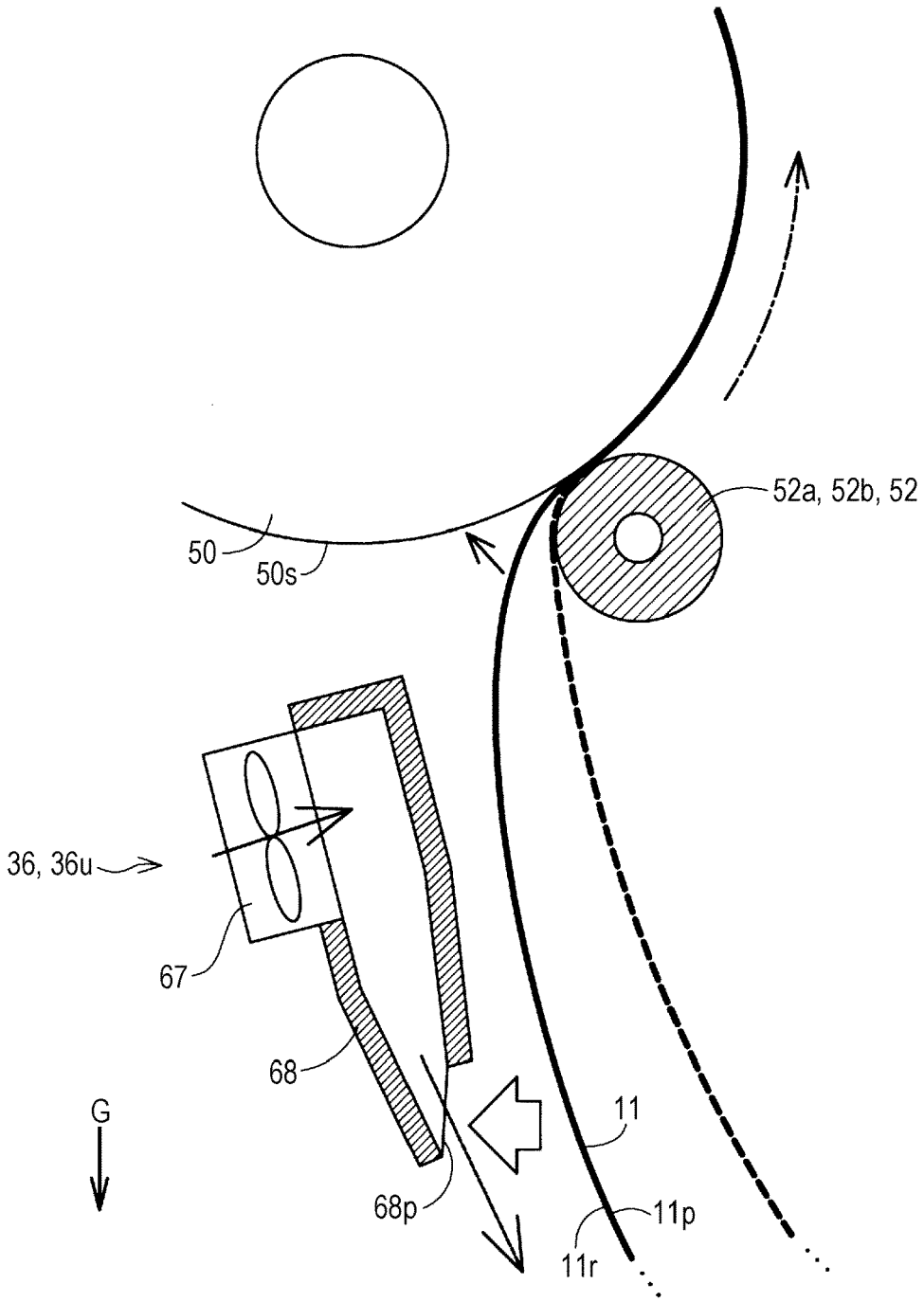
FIG. 10 is a schematic view illustrating a configuration of a printing apparatus of a third embodiment.

FIG. 10 is a schematic view illustrating a configuration of a printing portion 30B in a printing apparatus of a third embodiment. In FIG. 10, for convenience, only the configuration in the vicinity of the rotating drum 50 and the first driven roller 52 in the printing portion 30B of the third embodiment is extracted and illustrated. The printing apparatus of the third embodiment has a configuration which is substantially the same as that of the printing apparatus 10 (FIG. 1) of the first embodiment except that the base material suction portion 36 is added to a side which is closer to the upstream side than the top of the bending of the printing base material 11 on the inter-roller transporting path 38. Hereinafter, the base material suction portion 36 (FIG. 1) which is disposed to be closer to the downstream side than the top of the bending of the printing base material 11 illustrated in the first embodiment is called a "first base material suction portion 36*d*", and the base material suction portion 36 (FIG. 10) which is disposed on the upstream side is called a "second base material suction portion 36*u*".

The second base material suction portion 36*u* has a configuration which is substantially the same as that of the first base material suction portion 36*d* except that the position where the second base material suction portion 36*u* is disposed is different. The second base material suction portion 36*u* is disposed so that the air flow generated by the air blowing portion 67 flows downward along the rear surface 11*r* of the printing base material 11 at a position adjacent to the downstream side of the first driven roller 52. The second base material suction portion 36*u* is suppressed by the control portion 15, pauses when the printing base material 11 is transported in the first transporting direction, and is driven when the printing base material 11 is transported in the second transporting direction.

When the printing base material 11 is transported in the second transporting direction, the printing base material 11 is pulled to the second base material suction portion 36*u* side by the negative pressure generated by the second base material suction portion 36*u* in the region that faces the rear surface 11*r* of the printing base material 11. Accordingly, in a state where the printing base material 11 is displaced in a direction of being wound around the circumferential side surface 50*s* of the rotating drum 50, the printing base material 11 is wound around the rotating drum 50, and the position shift is suppressed, the printing base material 11 is fed in between the rotating drum 50 and the first driven roller 52. Therefore, similar to the second embodiment, generation of wrinkles on the printing base material 11 is suppressed.

As described above, according to the printing portion 30B of the third embodiment, it is possible to improve the properties that support the printing base material 11 by the rotating drum 50 when transporting the printing base material 11 in the second transporting direction by the second base material suction portion 36*u*. Accordingly, generation of wrinkles on the printing base material 11 when being transported in the second transporting direction is suppressed. In addition to this, according to the printing apparatus of the third embodiment, it is possible to achieve the operation effect which is similar to that of the printing apparatus 10 of the first embodiment.

D. Modification Example:

D1. Modification Example 1:

The printing apparatus of each of the above-described embodiments is configured as a line printer. In contrast to this, the printing apparatus of each of the above-described embodiments may be configured as a line printer, for example, may be configured as a serial type printer which discharges ink droplets as a carriage provided with the printing head reciprocates.

D2. Modification Example 2:

In each of the above-described embodiments, the guide plate 56 is disposed at the outlet through which the printing base material 11 is fed out between the rotating drum 50 and the first driven roller 52, and the guide plate 57 is disposed at the inlet through which the printing base material 11 is fed in between the driving roller 53 and the second driven roller 54. In contrast to this, any one of the guide plates 56 and 57 may be omitted, and both the guide plates 56 and 57 may be omitted.

D3. Modification Example 3:

In the printing apparatus of each of the above-described embodiments, the drying portion 40 is disposed at the position adjacent to the printing portions 30, 30A, and 30B in the horizontal direction. In contrast to this, the drying portion 40 may be disposed at a position other than the position adjacent to the printing portions 30, 30A, and 30B in the horizontal direction. The drying portion 40 may be disposed below the printing portions 30, 30A, and 30B. The drying portion 40 may be omitted in the printing apparatus of each of the above-described embodiments.

D4. Modification Example 4:

The transporting mechanism of the printing base material 11 in the printing portions 30, 30A, and 30B in each of the above-described embodiments can be employed in various devices as a transporting device which transports the belt-shaped base material in the longitudinal direction thereof, not being limited to the printing apparatus. For example, the transporting mechanism may be employed in a winding apparatus which winds a belt-shaped fiber base material, and may be employed in a manufacturing apparatus which consecutively disposes components on a surface of a belt-shaped material.

D5. Modification Example 5:

In each of the above-described embodiments, the tension applying portion 35 is provided with the base material storage portion 60 which has the wall portion that surrounds the bent part of the printing base material 11. In contrast to this, the tension applying portion 35 may not be provided with the base material storage portion 60. In addition, in each of the above-described embodiments, the tension applying portion 35 is provided with the distributing plate 62 or the movable type inner wall 63 inside the base material storage portion 60. In contrast to this, the distributing plate 62 or the movable type inner wall 63 inside the base material storage portion 60 may be omitted.

D6. Modification Example 6:

In each of the above-described embodiments, the looseness control portion 16 detects the variation amount of the height position of the bending of the printing base material 11 on the inter-roller transporting path 38 as the value which illustrates the level of the bending of the printing base material 11 on the inter-roller transporting path 38, by the detection sensor 39. In contrast to this, the looseness control portion 16 may detect other parameters as the value which illustrates the level of the bending of the printing base material 11 on the inter-roller transporting path 38, by a sensor other than the detection sensor 39. For example, the looseness control portion 16 may detect the variation amount of the height position of a predetermined part other than the top at the bent part of the printing base material 11 as the value which illustrates the level of the bending of the printing base material 11 on the inter-roller transporting path 38. Otherwise, the looseness control portion 16 may detect a variation amount of an inclination angle of the printing base material 11 at a predetermined position of the bent part of the printing base material 11 as the value which illustrates the level of the bending of the printing base material 11. The looseness control portion 16 may detect a difference between a measurement value of the transporting speed of the printing base material 11 on the inter-roller transporting path 38 and a measurement value of the transporting speed of the printing base material 11 on the upstream side of the inter-roller transporting path 38 as the value which illustrates the level of the bending of the printing base material 11 on the inter-roller transporting path 38.

D7. Modification Example 7:

In each of the above-described embodiments, the control portion 15 functions as the looseness control portion 16, and controls the rotating speed of the driving roller 53 and the suction force in the tension applying portion 35 based on the detection result of the detection sensor 39. In contrast to this, the looseness control portion 16 may also control only the rotating speed of the driving roller 53 based on the detection result of the detection sensor 39. In this case, the tension applying portion 35 may also be driven to always generate a constant level of suction force.

D8. Modification Example 8:

In each of the above-described embodiments, the second driven roller 54 includes two roller portions 54*a* and 54*b* disposed to be separated from each other in the width direction of the printing base material 11, and the two roller portions 54*a* and 54*b* are positioned on both sides of the printable area PA in the width direction of the printing base material 11. The second driven roller 54 may not include the two roller portions 54*a* and 54*b* which are disposed to be separated from each other in the width direction of the printing base material 11, and for example, may include a single roller portion which comes into contact with the printing base material 11 across the entire width direction of the printing base material 11. In addition, the two roller portions 54*a* and 54*b* of the second driven roller 54 may not be disposed on the outside of the printable area PA, and may be disposed at a position which overlaps the printable area PA. However, in these cases, in order to obtain an image quality which is the same as that in each of the above-described embodiments, it is desirable that the printed image is dried until the printed image and the second driven roller 54 come into contact with each other. The two roller portions 54*a* and 54*b* of the second driven roller 54 may be separated from each other in a direction which intersects with the transporting direction of the printing base material 11 other than the width direction of the printing base material 11.

D9. Modification Example 9:

In each of the above-described embodiments, the first driven roller 52 includes the two roller portions 52*a* and 52*b* which are disposed to be separated from each other in the width direction of the printing base material 11, and the two roller portions 52*a* and 52*b* are disposed on both sides of the printable area PA in the width direction of the printing base material 11. In contrast to this, the two roller portions 52*a* and 52*b* of the first driven roller 52 may also be separated from each other in the direction which intersects with the transporting direction of the printing base material 11 other than the width direction of the printing base material 11.

D10. Modification Example 10:

In each of the above-described embodiments, the first driven roller 52 includes the two roller portions 52*a* and 52*b* which are disposed to be separated from each other in the width direction of the printing base material 11, and the two roller portions 52*a* and 52*b* are disposed on both sides of the printable area PA in the width direction of the printing base material 11. The first driven roller 52 may also not include the two roller portions 52*a* and 52*b* which are disposed to be separated from each other in the width direction of the printing base material 11, and for example, may also include a single roller portion which comes into contact with the printing base material 11 across the entire width direction. In addition, the two roller portions 52*a* and 52*b* of the first driven roller 52 may also not be disposed on the outside of the printable region PA, and may also be disposed at a position which overlaps the printable region PA. However, in order to obtain the same image quality as that in each of the above-described embodiments in these cases, it is desirable that the printed image is dried until the printed image and the first driven roller 52 come into contact with each other.

D11. Modification Example 11:

In each of the above-described embodiments, the rotating drum 50 has a function as a platen. In contrast to this, the rotating drum 50 may not function as a platen, and may be configured only to function as a driving roller for transporting the printing base material 11. In this case, for example, each printing head 33 of the image forming portion 32 may be arranged in the horizontal direction at the position which is closer to the upstream side than the rotating drum 50, and may discharge the ink to the printing base material 11 which is transported horizontally. In addition, in this case, the diameter of the rotating drum 50 may be considered as a size which is similar to that of the driving roller 53, and the rotating drum 50 and the first driven roller 52 may be disposed so that the positional relationship thereof is axially symmetrical to the positional relationship between the driving roller 53 and the second driven roller 54 around a straight line which passes through the top of the bending of the printing base material 11.

D12. Modification Example 12:

In each of the above-described embodiments, the first driven roller 52 is disposed at the position where it is possible to regulate the terminal position in the transporting direction of the winding of the printing base material 11 with respect to the rotating drum 50. In contrast to this, the first drive roller 52 may not be disposed at the position where it is possible to regulate the terminal position in the transporting direction of the winding of the printing base material 11 with respect to the rotating drum 50. For example, the first driven roller 52 may also be disposed to press the printing base material 11 at a position above the end portion of the circumferential side surface 50*s* of the rotating drum 50 in the horizontal direction.

D13. Modification Example 13:

In each of the above-described embodiments, the tension applying portion 35 is disposed on the inter-roller transporting path 38. In contrast to this, the tension applying portion 35 may be omitted.

D14. Modification Example 14:

In the above-described second embodiment, when the printing base material 11 is transported in the second transporting direction, the range in which the printing base material 11 is wound around the first driven roller 52 is changed by the displacement roller 70, and in addition to this, the bending of the printing base material 11 on the inter-roller transporting path 38 is released by pressing the printing base material 11 by the tension adjustment roller 74. In contrast to this, in the configuration of the second embodiment, the tension adjustment roller 74 may also be omitted, and the printing base material 11 may also be transported in the second transporting direction in a state where the bending is not released. Even in this case, as the range of the winding of the printing base material 11 around the first driven roller 52 changes by the displacement roller 70, the properties that support the rotating drum 50 with respect to the printing base material 11 which is transported in the second transporting direction are improved.

D15. Modification Example 15:

In each of the above-described embodiments, the control portion 15 functions as the looseness control portion 16, and controls the rotating speed of the driving roller 53 and the suction force in the tension applying portion 35 based on the detection result of the detection sensor 39. In contrast to this, the looseness control portion 16 may also control only the suction force in the tension applying portion 35 based on the detection result of the detection sensor 39.

The invention can be realized by various configurations within the scope without departing the spirit thereof, not being limited to the above-described embodiments, examples, and modification examples. For example, in order to solve a part or the entirety of the above-described problem, or in order to achieve a part or the entirety of the above-described effects, the technical characteristics in the embodiments, the examples and the modification examples which correspond to the technical characteristics in each aspect described in summary of the invention, can be appropriately replaced or combined. In addition, if the technical characteristics are not illustrated as essential in the specification, the characteristics can be appropriately eliminated.

The entire disclosure of Japanese Patent Application No. 2014-216239, filed Oct. 23, 2014 is expressly incorporated by reference herein.

What is claimed is:

1. A transporting device which transports a belt-shaped base material by considering a longitudinal direction of the base material as a transporting direction, the apparatus comprising:

a first driving roller which transports the base material in the transporting direction by winding the base material and rotating;

a second driving roller which is disposed to be closer to a downstream side of the transporting direction than the first driving roller, and transports the base material in the transporting direction by winding the base material and rotating;

a driven roller which nips the base material between the second driving roller and the driven roller, and rotates together with the second driving roller;

an inter-roller transporting path which is provided between the first driving roller and the second driving roller, and through which the base material is transported in a state where the base material is suspended in a direction of gravity and bent; and a first suction portion which suctions the base material from a roller contact surface side which is a surface on a side that comes into contact with the second driving roller on the base material, wherein the first suction portion is configured to blow air along the roller contact surface side, the blown air generating a negative pressure along the roller contract surface side that suctions the base material to the first suction portion, wherein the second driving roller starts winding the base material at a position which is closer to an upstream side of the transporting direction than a position where the driven roller is in contact with the base material.

2. The transporting device according to claim 1, wherein the first suction portion is between a top of bending of the base material on the inter-roller transporting path and the second driving roller.

3. The transporting device according to claim 2, wherein the first suction portion suctions the base material in a state of not being in contact with the base material.

4. A printing apparatus which forms a printed image on a belt-shaped printing base material, the apparatus comprising:

the transporting device according to claim 3 which transports the printing base material as the base material.

5. The transporting device according to claim 2, wherein the first suction portion generates negative pressure in a region which faces the roller contact surface by generating an air flow along the roller contact surface of the base material, and suctions the base material.

6. A printing apparatus which forms a printed image on a belt-shaped printing base material, the apparatus comprising:

the transporting device according to claim 5 which transports the printing base material as the base material.

7. A printing apparatus which forms a printed image on a belt-shaped printing base material, the apparatus comprising:

the transporting device according to claim 2 which transports the printing base material as the base material.

8. The transporting device according to claim 1, wherein the driven roller presses the base material at a part on both sides in a direction which intersects with the transporting direction of a predetermined region which extends in the transporting direction of the base material.

9. A printing apparatus which forms a printed image on a belt-shaped printing base material, the apparatus comprising:

the transporting device according to claim 8 which transports the printing base material as the base material.

10. The transporting device according to claim 1, wherein a first guide portion which regulates a position shift of the base material in the direction which intersects with the transporting direction is disposed at an inlet through which the base material is guided between the second driving roller and the driven roller.

11. A printing apparatus which forms a printed image on a belt-shaped printing base material, the apparatus comprising:

the transporting device according to claim 10 which transports the printing base material as the base material.

12. The transporting device according to claim 1, further comprising:

a tension applying portion which has a wall portion that is disposed to surround a bent part of the base material on the inter-roller transporting path, suctions the base material stored in a space surrounded by the wall portion in the direction of gravity, and applies tension to the base material.

13. A printing apparatus which forms a printed image on a belt-shaped printing base material, the apparatus comprising:

the transporting device according to claim 12 which transports the printing base material as the base material.

14. The transporting device according to claim 1, wherein a suction force in the first suction portion is smaller than a suction force in the tension applying portion.

15. A printing apparatus which forms a printed image on a belt-shaped printing base material, the apparatus comprising:

the transporting device according to claim 14 which transports the printing base material as the base material.

16. The transporting device according to claim 1, further comprising:

a second suction portion which suctions the base material from the roller contact surface side of the base material between the first driving roller on the inter-roller transporting path and the top of the bending of the base material.

17. A printing apparatus which forms a printed image on a belt-shaped printing base material, the apparatus comprising:

the transporting device according to claim 16 which transports the printing base material as the base material.

18. The transporting device according to claim 1, further comprising:

a first driven roller; and a second driven roller which is the driven roller, wherein the first driven roller nips the base material between the first driving roller and the first driven roller, and rotates together with the first driving roller, and wherein the second driving roller is at a higher position in the direction of gravity than the first driven roller.

19. The transporting device according to claim 18, wherein a guide portion which regulates a position shift of the base material in the direction which intersects with the transporting direction is disposed at an outlet through which the base material is fed out between the first driving roller and the first driven roller.

20. A printing apparatus which forms a printed image on a belt-shaped printing base material, the apparatus comprising:

the transporting device according to claim 1 which transports the printing base material as the base material.

* * * * *